US011802494B2

(12) United States Patent
Bini et al.

(10) Patent No.: US 11,802,494 B2
(45) Date of Patent: Oct. 31, 2023

(54) OPTIMIZED CASCADE ORGANIC RANKINE CYCLE

(71) Applicant: TURBODEN S.P.A., Brescia (IT)

(72) Inventors: Roberto Bini, Brescia (IT); Mario Gaia, Brescia (IT); Claudio Pietra, Brescia (IT)

(73) Assignee: TURBODEN S.p.A., Brescia (IT)

( * ) Notice: Subject to any disclaimer, the term of this patent is extended or adjusted under 35 U.S.C. 154(b) by 98 days.

(21) Appl. No.: 17/603,157

(22) PCT Filed: Apr. 30, 2020

(86) PCT No.: PCT/IB2020/054071

§ 371 (c)(1),
(2) Date: Oct. 12, 2021

(87) PCT Pub. No.: WO2020/225660

PCT Pub. Date: Nov. 12, 2020

(65) Prior Publication Data

US 2022/0205370 A1 Jun. 30, 2022

(30) Foreign Application Priority Data

May 7, 2019 (IT) ..... 102019000006589

(51) Int. Cl.
*F01K 9/00* (2006.01)

(52) U.S. Cl.
CPC ..... *F01K 9/003* (2013.01); *F05D 2220/32* (2013.01); *F05D 2220/76* (2013.01)

(58) Field of Classification Search
CPC ..... F05D 2220/76; F05D 2220/32
See application file for complete search history.

(56) References Cited

U.S. PATENT DOCUMENTS

2010/0263380 A1* 10/2010 Biederman ..... F02G 5/04 60/651
2011/0314818 A1* 12/2011 Breen ..... F01K 25/10 60/676

(Continued)

FOREIGN PATENT DOCUMENTS

CN 103195518 A * 7/2013

OTHER PUBLICATIONS

English Translation CN-103195518-A (Year: 2013).*

*Primary Examiner* — Shafiq Mian
(74) *Attorney, Agent, or Firm* — R. Ruschena Patent Agent, LLC

(57) ABSTRACT

A cascade organic Rankine cycle plant comprising a hot source, at least a first high temperature organic Rankine cycle and a second low temperature organic Rankine cycle, said cycles comprising at least one preheater, at least one vaporizer, at least one turbine, at least one condenser, wherein the hot source first supplies a vaporizer of the high temperature cycle, then the vaporizer of the low temperature cycle and finally it is divided into two flows which supply a first preheater of the high temperature cycle and a preheater of the low temperature cycle. The first high-temperature organic Rankine cycle comprises a further vaporizer operating at an intermediate pressure between the vaporizer pressure of the high temperature cycle and the vaporizer pressure of the low temperature cycle.

8 Claims, 5 Drawing Sheets

(56) References Cited

U.S. PATENT DOCUMENTS

| | | | | |
|---|---|---|---|---|
| 2014/0075937 | A1* | 3/2014 | Batscha | F03G 7/04<br>60/641.1 |
| 2015/0075164 | A1* | 3/2015 | Batscha | F01K 23/00<br>60/645 |
| 2015/0135709 | A1* | 5/2015 | Batscha | F01K 25/08<br>60/671 |

* cited by examiner

OPTIMIZED CASCADE ORGANIC RANKINE CYCLE

CROSS REFERENCE TO RELATED APPLICATIONS

This is a national stage application of PCT application PCT/IB2020/053343 having an international filing date of Apr. 8, 2020. This application claims foreign priority based on application No. 102019000006817 filed with the Italian Patent Office on May 14, 2019.

FIELD OF THE INVENTION

The present and invention relates to an innovative cascade organic Rankine cycle plant which exploits a source of sensible heat at low or medium temperature, for example of geothermal or industrial heat recovery type.

BACKGROUND OF THE INVENTION

As known, a finite sequence of thermodynamic transformations (for example isothermal, isochoric, isobaric or adiabatic transformations) is defined as a thermodynamic cycle, at the end of which the system returns to its initial state. In particular, an ideal Rankine cycle is a thermodynamic cycle consisting of two adiabatic and two isobaric transformations, with two phase changes, from liquid to vapor and from vapor to liquid. Its purpose is to transform heat into work. This cycle is generally adopted mainly in thermoelectric power plants for the production of electricity and uses water, both in liquid and vapor form, as driving fluid, and the corresponding expansion takes place in the so-called steam turbine.

In addition to Rankine cycles with water as a working fluid, organic Rankine cycles (ORC) have been conceived and created which use high molecular mass organic fluids for the most various applications, in particular also for the exploitation of low-medium temperature thermal sources temperature. As in other steam cycles, the plant for an ORC cycle includes one or more pumps for feeding the organic working fluid, one or more heat exchangers for carrying out the preheating, vaporization and possible overheating or heating phases in supercritical conditions of the same working fluid, a steam turbine for the expansion of the fluid, mechanically connected to an electric generator or an operating machine, a condenser which brings the organic fluid back to the liquid state and a possible regenerator for recovering the heat downstream of the turbine and upstream of the condenser.

In heat recovery and geothermal applications, the adoption of an organic Rankine cycle has proven to be a feasible, efficient and economic solution compared to the traditional steam cycle, in particular when the temperature of the heat source is from medium to low (i.e. less than 250° C.) and in particular in the sources is mainly present in liquid or mixed liquid+vapor phase.

In the case of a heat source mainly in liquid phase (as in the case of geothermal energy, the introduction of heat into the thermodynamic cycle from the hot source takes place at highly variable temperatures. On the contrary, the transfer of heat from the cold source to the cycle condenser is mainly made at a slightly variable temperature as the technical-economic optimization of the flow rate of the cooling fluid (both air and water) usually leads to the use of large flow rates and therefore to small temperature differences.

In FIGS. 1*a-e* the thermodynamic cycles associated with heat sources as indicated above are represented in the Temperature-Entropy plane.

TH_in and TH_out indicate respectively the inlet and outlet temperature of the hot source, while TC_in and TC_out respectively indicate the inlet and outlet temperature of the cold source.

In the five cycles shown in FIGS. 1*a-e*, the temperatures of the hot and cold sources are the same. The cycles shown in FIGS. 1*a* and 1*b* are ideal cycles as:

- the heat exchange with the sources takes place with a minimum temperature difference equal to zero (corresponding to an infinite surface of the exchanger),
- the adiabatic compression and expansion transformations are ideal and then are represented by two vertical segments (no entropy increase).

It is noted that for graphic needs, the dotted line representing the introduction of heat into the cycle, even in these two ideal cycles, is drawn slightly offset from the line representing the heat transfer curve. Furthermore, the heat transfer curves are represented with straight segments even if in reality in the Ts plane said lines should be slightly curved.

If the small temperature variation of the cold source is not considered, the ideal thermodynamic cycle which maximizes the conversion efficiency is a trapezoidal cycle (FIG. 1*a*) as it fits better than the Carnot cycle (of rectangular shape, FIG. 1*b*) to the variable temperature source, and maximizes the Work L (corresponding to the area of the cycle itself). A real organic cycle (FIG. 1*c*) has a more or less favorable heat introduction curve according to the critical temperature T_CR of the fluid adopted in relation to the source temperature. A hypercritical cycle (FIG. 1*d*) potentially has the thermodynamic advantages compared to subcritical cycles, since as can be seen it approaches the ideal trapezoidal cycle of FIG. 1*a* (as can be seen by comparing the areas L representing the working cycle).

With regard to the correct sizing of the machines, in order to avoid high pressures or in any case to take advantage of other favorable characteristics of the organic fluids, it is often preferred to resort to a diagram with multiple pressure levels such as the one shown in FIG. 1*e*, which also approaches in terms of quantity of extracted work Li+L2 to the trapezoidal cycle.

A scheme widely adopted since the 1980s is a two-level plant scheme, such as the one described, for example, in document GB2162583A. The cycle described is called "cascade" as it uses different levels of temperature (and pressure) such as the one shown in FIG. 1 so allowing to better exploit the heat source. In other words the cascade cycle uses a plurality of modules with a Rankine cycle, each having an associated heat exchanger, the source fluid being applied in series to the heat exchangers of each module, in order to maximize the net power produced by the system. Typically, in the case of two modules, they will be indicated as high temperature cycle and low temperature cycle.

With reference to FIG. 2 and to the aforementioned patent, in a cascade cycle according to the prior art, the hot source firstly feeds the vaporizer of the high temperature cycle (HT, PRE+EV). The high temperature vaporizer performs both a preheating of the organic fluid and its vaporization (and possibly also an overheating) and can be carried out either in a single container (as in document GB2162583A and as in FIG. 2) or in two different containers (as in a similar document EP2217793). The hot source then passes through the vaporizer of the low temperature cycle (LT, EV), then it is divided into two flows which feed two partial preheaters of the high temperature (HT, PRE) and low temperature (LT, PRE) cycles.

The prior art documents reported above refer to a two-level cascade cycle, but the same principle can be applied to a greater number of "levels".

As seen therefore, a technique to increase the power consists in extracting more heat from the source fluid by increasing the overall temperature drop at the end of the heat exchanges and at the same time by trying to keep as high as possible the temperature of generation of the steam that feeds the turbine, in order to keep high the efficiency of converting heat into mechanical energy. A cascade system still fulfills this task (compared to a single-level subcritical cycle such as the one shown in FIG. 1*a*) as it is closer to the ideal trapezoidal cycle of FIG. 1*a*.

There is however the need to further optimize the efficiency of an organic cascade Rankine cycle, in order to improve the economic yield in particular of geothermal plants, which are often heavily penalized by high costs for the realization of the working operations and for which therefore an increase in electrical production is significantly helpful.

SUMMARY OF THE INVENTION

The aim of the present invention is to further increase the efficiency of an organic Rankine cycle, by using an optimized cascade cycle.

In particular, the organic cascade Rankine cycle which is the object of the present invention includes a first high-temperature cycle, a second low-temperature cycle, wherein the first high-temperature cycle comprises a further vaporizer working at an intermediate pressure between the pressure of the vaporizer of the high temperature cycle and the pressure of the vaporizer of the low temperature cycle. Said further vaporizer is fed by a partial flow of the hot source extracted downstream of the first vaporizer and upstream of a preheater of the same high temperature cycle, according to independent claim 1.

Further preferred and/or particularly advantageous embodiments of the invention are described according to the characteristics set out in the annexed dependent claims.

BRIEF DESCRIPTION OF THE DRAWINGS

The invention will now be described with reference to the annexed drawings, which illustrate some non-limiting examples of embodiments, in which.

DETAILED DESCRIPTION OF THE INVENTION OR OF THE PREFERRED EMBODIMENTS

The invention relates to an optimized organic cascade Rankine cycle.

Figure 4:
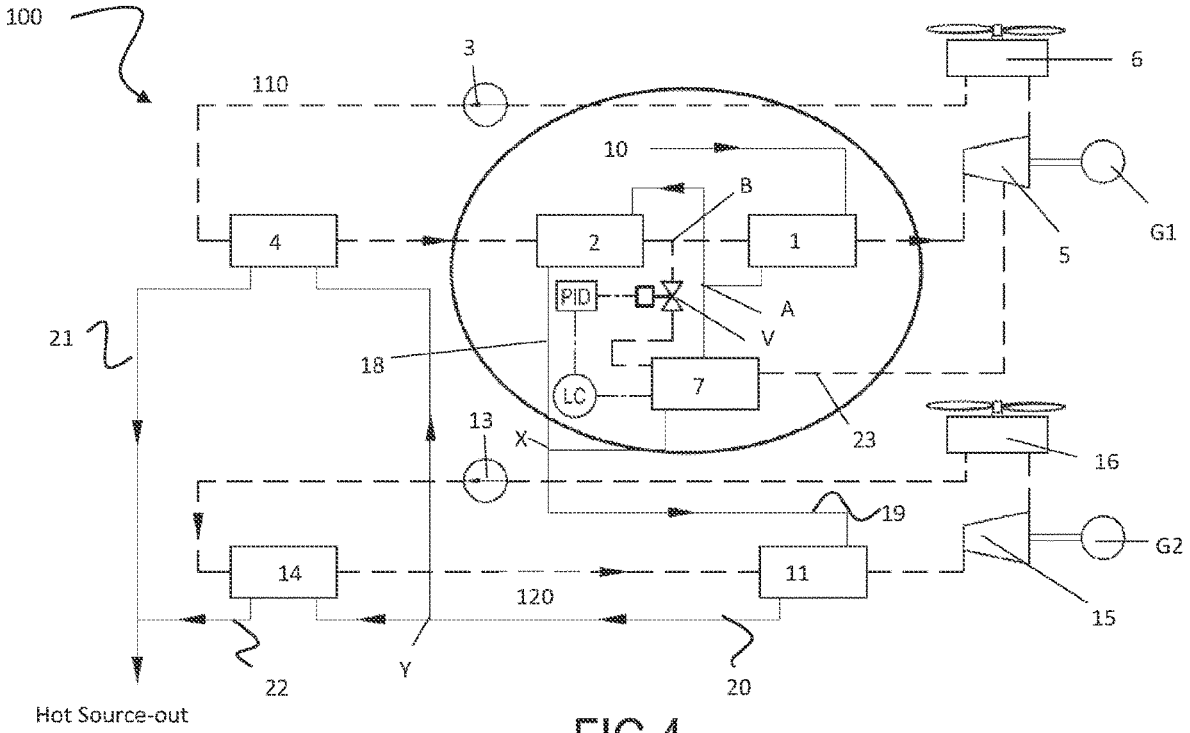
FIG. 4 is a scheme of the organic cascade Rankine cycle in a first embodiment of the present invention, represented by the elements forming the same.

FIG. 4 shows a scheme of a optimized organic cascade Rankine cycle 100 according to the present invention, comprising a first high temperature cycle 110, a second low temperature cycle 120 and a hot source 10, for example a geothermal source, which feeds a to plurality of heat exchangers belonging to these aforementioned two cycles. In FIG. 4 the dotted lines represent the path of the organic fluid (high and low temperature), whereas the solid line identifies the path of the fluid that constitutes the hot source, hereinafter simply called 'hot source'.

In more detail, the high temperature cycle 110 comprises a supply pump 3 for pressurizing the organic fluid, a first preheater 4 which causes a first increase in the temperature of the organic fluid and a second preheater 2 which further raises its temperature.

Then the organic fluid of the high temperature cycle passes through a vaporizer 1 in which the passage to the vapor state and its possible overheating take place.

The heat exchanger of the high temperature cycle has been divided into two separate containers: a preheater 2 and a vaporizer 1. Preheater 2 and vaporizer 1 perform the same thermodynamic function as the exchanger described, for example, in GB2162583A, here called 'vaporizer' with reference to the fact that it produces steam but being clearly indicated in the text which also performs the function of preheating the organic fluid. The organic fluid in the vapor phase passes through a turbine 5 into which it expands. The mechanical energy collected by the turbine 5 is used for supplying an electric generator G1 or another user. The organic fluid finally passes through a condenser 6 where it returns to the liquid state and starts the cycle again.

Similarly, the low temperature cycle 120 comprises a supply pump 13, a preheater 14, a vaporizer 11, a turbine 15 connected to a generator G2 and a condenser 16. All these components, evidently, operate on the organic fluid of this low temperature cycle in the same way as the homologous components of the high temperature cycle.

In an alternative configuration, according to the prior art, a single generator could be replaced with the generators G1 and G2, with the two turbines 5 and 15 connected to the two outlet shaft (on opposite sides) of the generator.

Obviously, the organic cascade cycle 100 according to the present invention may be provided with a number greater than two cycles, just as one or more cycles may provide for the use of further preheaters and/or recuperators (also called 'regenerators') installed downstream of the turbines with the function of further preheating the liquid at the expense of the sensitive heat of the steam discharged from the turbine itself) as well as all the accessory components typical of organic Rankine cycles.

According to the present invention, the thermodynamic cycle is provided with a further vaporizer 7, operating at an intermediate pressure between the pressure of the vaporizer 1 and the pressure of the vaporizer 11 of the low temperature cycle.

The hot source 10 feeds the heat exchangers illustrated so far in the following way: firstly it passes through the first vaporizer 1 of the high temperature cycle 110, then by means of a branch identified by point A in FIG. 4, it partially and parallel passes through the second preheater 2 and the further vaporizer 7. Subsequently, the outlets of the hot source from the preheater 2 and from the vaporizer 7 join in point 'X' and the hot source 10 in its entirety passes through the low temperature vaporizer 11. Finally, the hot source 10 is divided into 2 flows leaving the point indicated by 'U' and partially and parallel passes through the first preheater 4 of the high temperature cycle and the preheater 14 of the low temperature cycle.

Considering the working fluid of the high temperature cycle 110, the further vaporizer 7 is fed by a partial flow of liquid extracted at the outlet of the preheater 2 (point B in FIG. 4), which is laminated by means of a specific lamination valve V, at the appropriate intermediate pressure of the further vaporizer 7. This lamination will cause a partial evaporation of the fluid and a complete evaporation will be obtained in the further vaporizer 7.

The partial flow exits the vaporizer 7 and feeds the high pressure turbine 5. This intermediate pressure fluid may be used in the turbine 5 at high pressure for two alternative functions:

a. the steam is injected into the turbine 5 in the vicinity of a labyrinth seal to provide a barrier and neutralize losses of the labyrinth itself, according to the teaching of patent application No EP3405653 of the writer;
b. an intermediate pressure stage of the turbine is supplied, following for example the teaching of patent application No EP 3455465 of the writer. In both cases, the innovative cascade Rankine cycle 100 allows a not insignificant increase in plant performances, in terms of mechanical/electrical power, the size of which is related to the actual design of the turbine and to the thermodynamic cycle.

This configuration also represents a simple solution as it does not involve the addition of a further turbine (but only a modification thereof or the addition of a point of introduction of steam into the intermediate pressure turbine) and the addition of a single additional heat exchanger. It is also a technically different and simpler solution than the addition of a further cascade cycle according to the prior art of GB2162583A, as in addition to the evaporator, a further preheater, a further turbine and a further condenser are not added.

In geothermal applications in general, the heat exchangers used are of the tube bundle type with the hot geothermal source inside the pipes of the tube bundle and the organic fluid outside the tubes or inside the casing, in order to allow easy cleaning of the pipes (for example by brushing). This type of heat exchanger can also be adopted for the further vaporizer 7 and, in order to obtain an adequate control of the system, it is possible to control the liquid level within the vaporizer 7 with a valve V. Said valve V allows to control the level of organic liquid present in the casing of the vaporizer 3 by means of a 'LC' level meter. The 'LC' level meter actuates the valve V through, for example, a control with PID (Proportional Integral Derivative) logic.

Figure 1A:
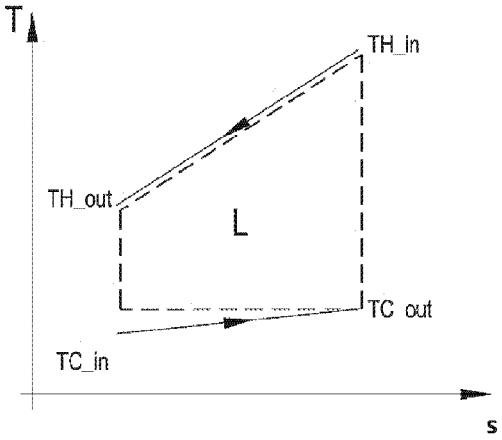
FIG.1a PRIOR ART
FIGS. 1_*a* to 1_*e* represent thermodynamic cycles according to the prior art.
Figure 1B:
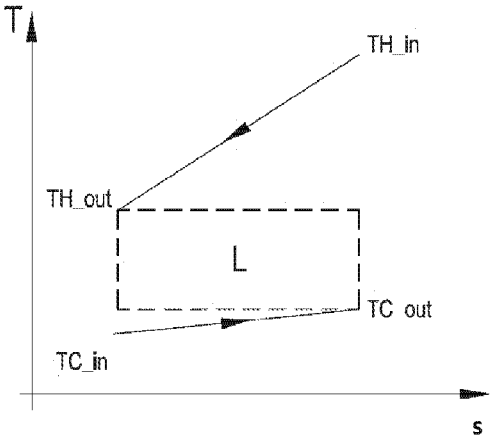
FIG.1b PRIOR ART
Figure 1C:
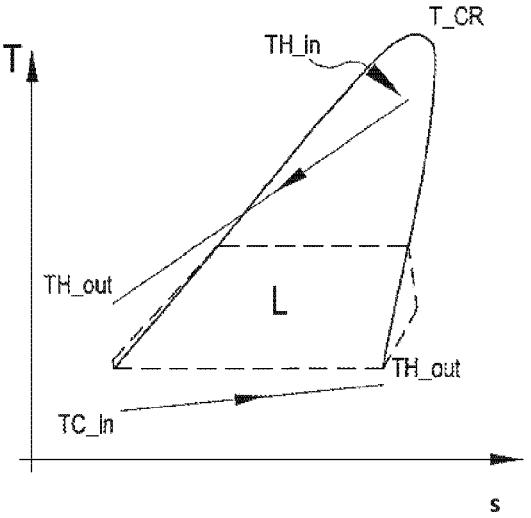
FIG.1c PRIOR ART
Figure 1D:
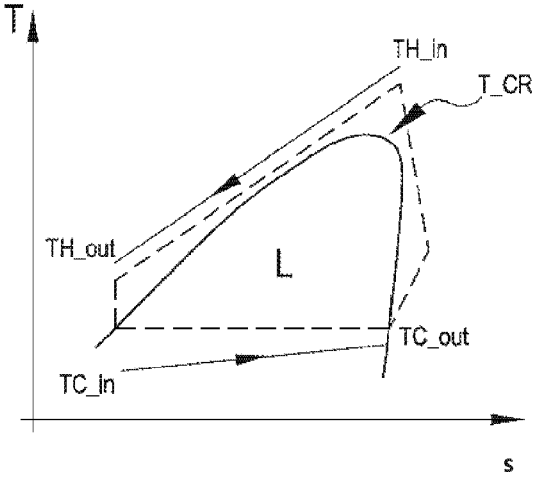
FIG.1d PRIOR ART
Figure 1E:
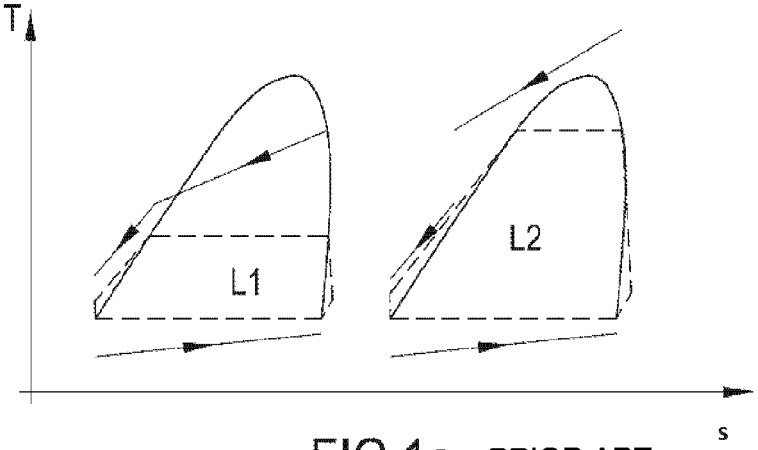
FIG.1e PRIOR ART
Figure 2:
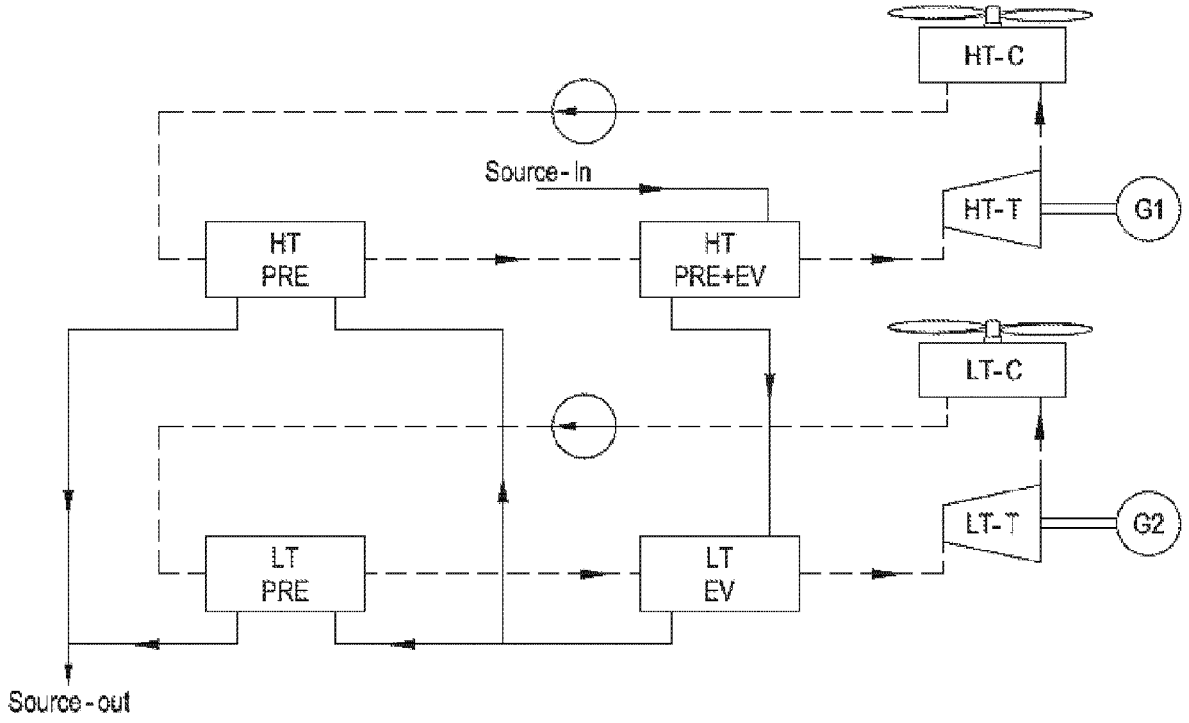
FIG.2 PRIOR ART
FIG. 2 represents a cascade cycle according to the prior art.
Figure 3:
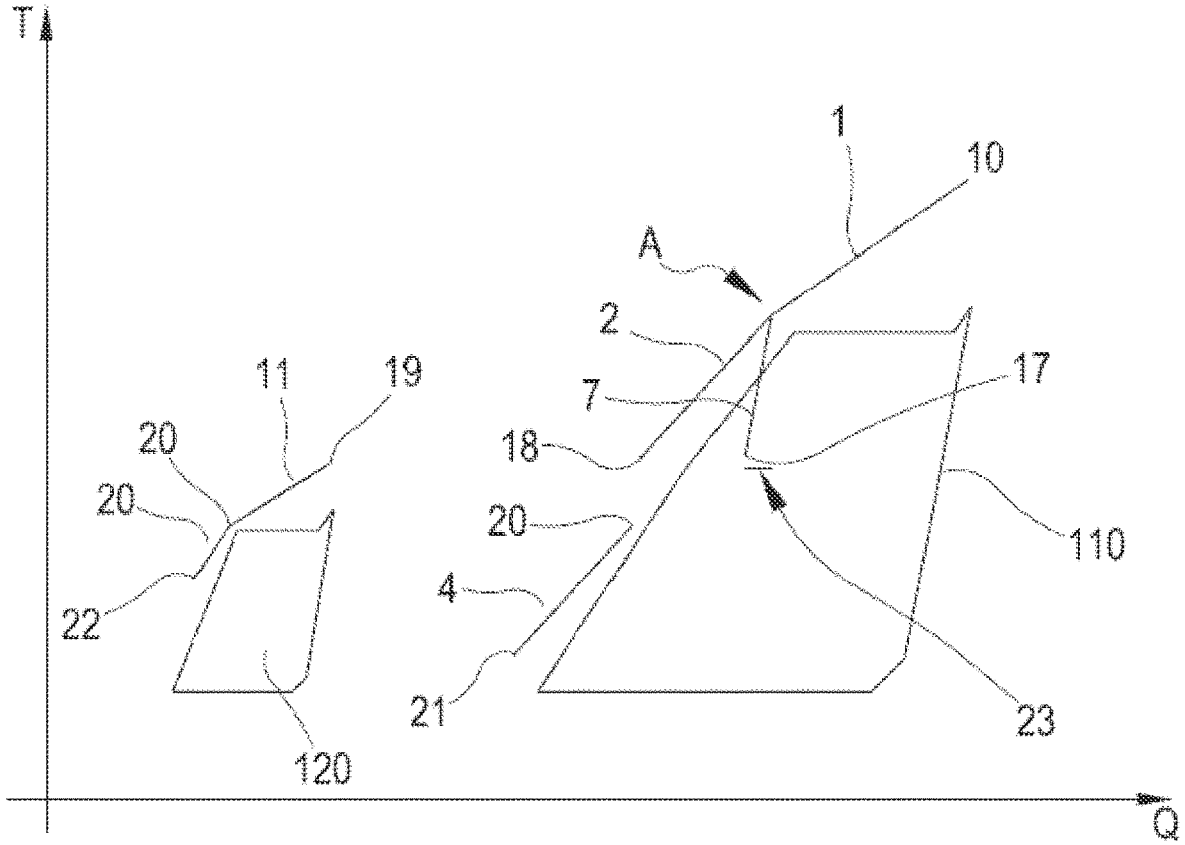
FIG. 3 is a scheme of the organic cascade Rankine cycle in a first embodiment of the present invention, represented in the diagram Temperature-exchanged Power.

FIG. 3 represents a schematic Temperature-Thermal Power diagram relating to the invention. The thermal power represents the thermal powers exchanged in the heat exchangers. The representative lines of the transformations in the machines are represented with the same continuous line and join the end point of the transformations in the previous exchanger and the start point of the next exchanger, according to a tradition consolidated in the representative technique of the cycles. Substantially, small adiabatic transformations (such as those of the supply pump) are not highlighted.

The Figure shows the two high temperature 110 and low temperature 120 cycles and, in particular, the cooling curve of the hot source in the case of a liquid source with points:

10: hot source inlet,
A: separation point of the 2 flows at the outlet of the vaporizer 1,
17: outlet of the hot source from the additional vaporizer 7,
18: water outlet from the preheater 2,
19: inlet of the source into the low temperature vaporizer 11,
20: water outlet from the vaporizer 11 and inlet into the preheater 4,
21: outlet of the source from the preheater 4,
22: outlet of the source from the preheater 14,
23: steam outlet from the additional vaporizer 7.

Figure 6:
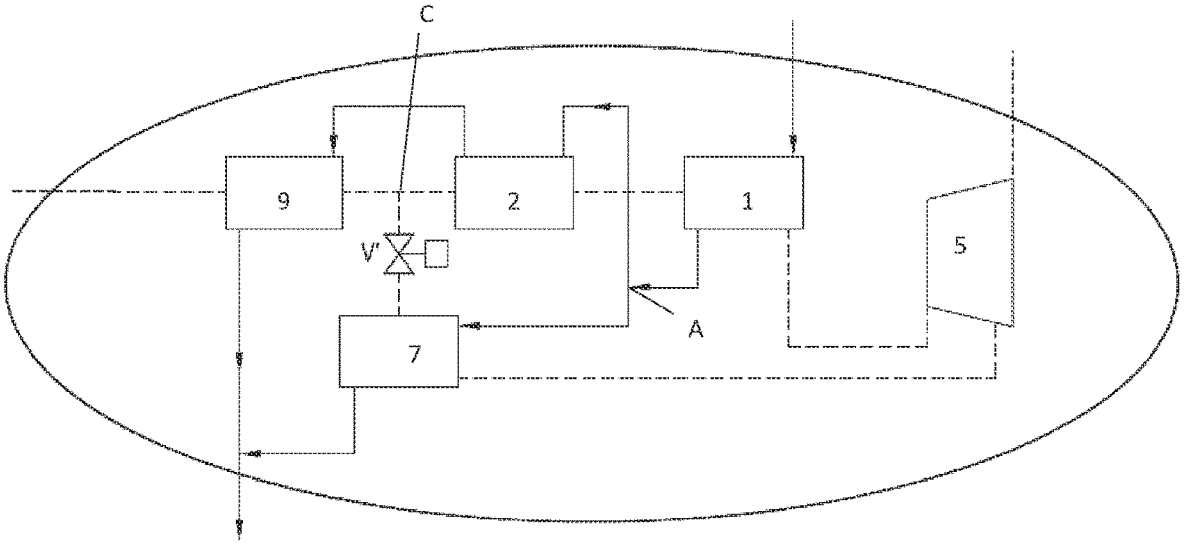
FIG. 6 is a detail of the scheme of FIG. 4, in a further embodiment of the present invention.

A second embodiment of the present invention is shown in FIG. 6. The high temperature cycle 110 (the Figure shows the relevant detail for the purposes of the second embodiment) comprises a third preheater 9 in an intermediate position between the first preheater 4 and the second preheater 2. The partitioning of the hot source 10 is always carried out downstream of the vaporizer 1 (point A), whereas the one of the organic liquid in point C is carried out downstream of the further preheater 9 (and upstream of the preheater 2) by means of a valve V. In this way it is possible to make the withdrawal temperature of the working fluid downstream of 9 be closer to that of vaporization in 7, compared to the case of a lamination starting from a higher temperature, such as that downstream of the preheater 2.

Figure 5:
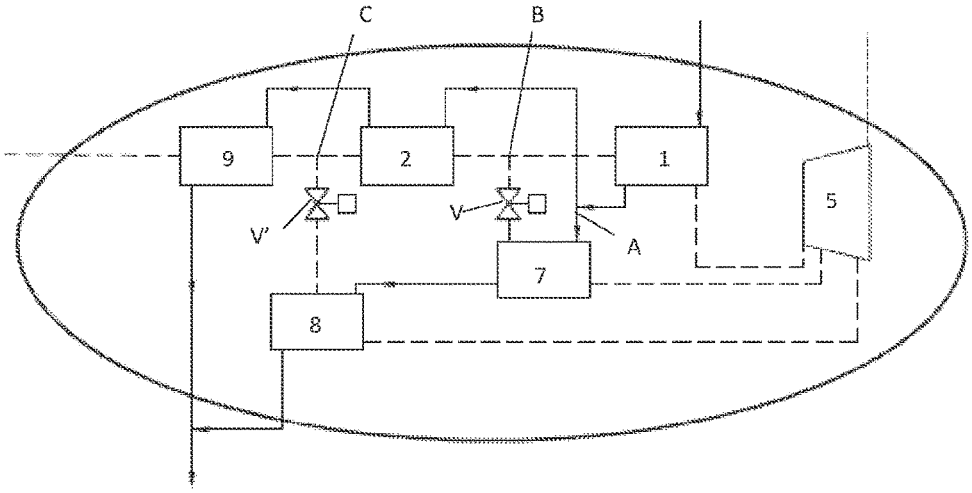
FIG. 5 is a detail of the scheme of FIG. 4, in a alternative embodiment of the present invention.

A third embodiment of the present invention is shown in FIG. 5. Compared to the cycle illustrated in FIG. 6, in this case the high temperature cycle 110 (the Figure shows the detail of interest) comprises a further vaporizer 8, positioned, following the flow of the hot source 10, downstream of the vaporizer 7 and upstream of the vaporizer 11 of the low temperature cycle. Said vaporizer 8 operates at a pressure lower than the pressure of the vaporizer 7, but higher than the pressure corresponding to the temperature of the vaporizer 11 of the low temperature cycle 120.

In this embodiment, therefore, a double withdrawal of working fluid occurs downstream of each preheater, respectively downstream of the preheater 9 (point C) and downstream of the preheater 2 (point B) towards the vaporizer 8 and the vaporizer 7 respectively.

The outgoing flows respectively from the vaporizer 8 and from the vaporizer 7, at different pressure levels, reach the turbine 5 and can be used, as in previous cases, in order to neutralize a loss in two labyrinths in the turbine (which operate at different pressures) following either the teaching of patent application No EP3405653 of the writer or for feeding an intermediate pressure stage of the turbine, following for example the teaching of patent application No EP3455465 of the writer.

In the event that the cycle used is has three levels instead of two levels (as described for example in GB2162583A), the proposed solution can be applied both to the higher temperature level (first level) and to the intermediate one, by using in the intermediate cycle a pattern identical to the one of the upper cycle. In this case, the further vaporizer supplies the second turbine, that is the one at an intermediate level.

Both in the case of a two-level and a three-level cycle, for the section at the lower temperature level (last level) the scheme proposed in patent EP3455465 can also be used, in which the flow from the additional vaporizer supplies either a labyrinth (as said in EP3455465) or a suitable intermediate pressure section in the low level turbine itself.

In addition to the embodiments of the invention, as described above, it is to be understood that there are numerous further variants. It must also be understood that said embodiments are only examples and do not limit either the scope of the invention, or its applications, or its possible configurations. On the contrary, although the above description makes it possible for the skilled man to implement the present invention at least according to an exemplary configuration, it must be understood that numerous variants of the described components are conceivable, without thereby leaving the scope of the invention, as defined in the attached claims, interpreted literally and/or according to their legal equivalents.

What is claimed is:

1. A cascade Organic Rankine Cycle (ORC) system (100) comprising:

at least a high temperature ORC (110) and a low temperature ORC (120);

said high temperature ORC (110), comprising:

at least a first preheater (2), a first vaporizer (1), a second vaporizer (7);

said high temperature ORC (110) is further comprising:

at least one turbine (5) of the high temperature ORC (110), at least a first condenser (6), a second preheater (4);

wherein said low temperature ORC (120) comprises:

at least one turbine (15) of the low temperature ORC (120), at least a second condenser (16) of the low temperature ORC (120), a third preheater (14), a third vaporizer (11);

wherein a hot source fluid (10) first supplies said first vaporizer (1) of the high temperature ORC (110), then supplies said third vaporizer (11) of the low temperature ORC (120);

and wherein said hot source fluid (10) is divided into two flows which feed the second preheater (4) of the high temperature ORC (110) and the third preheater (14) of the low temperature ORC (120);

and wherein said second vaporizer (7) of the high temperature ORC (110) is operating at an intermediate pressure between the pressure of the first vaporizer (1) of the high temperature ORC (110) and the pressure of the third vaporizer (11) of the low temperature ORC (120);

and wherein said second vaporizer (7) being fed by a partial flow of the hot source fluid (10) extracted downstream of the first vaporizer (1) and upstream of the first preheater (2) of the same high temperature ORC (110);

and wherein said second vaporizer (7) being used to produce organic fluid vapor at an intermediate pressure to be used in the at least one turbine (5) of the high temperature ORC (110).

2. The cascade ORC system (100) according to claim 1, wherein said organic fluid vapor at the intermediate pressure is injected into the at least one turbine (5) of the high temperature ORC (110) near a labyrinth seal to provide a barrier against a leakage from said labyrinth seal itself.

3. The cascade ORC system (100) according to claim 1, wherein said organic fluid vapor at the intermediate pressure supplies an intermediate stage of the at least one turbine (5) of the high temperature ORC (110).

4. The cascade ORC system (100) according to claim 1, wherein the high temperature ORC (110) comprises a fourth preheater (9) in an intermediate position between the second preheater (4) and the first preheater (2).

5. The cascade ORC system (100) according to claim 1, wherein a choking of the hot source fluid (10) is carried out downstream of the first vaporizer (1), while a choking of the hot source fluid (10) is carried out downstream of the fourth preheater (9) and upstream of the first preheater (2), by means of a valve (V).

6. The cascade ORC system (100) according to claim 1, wherein said high temperature ORC (110) comprises a fourth vaporizer (8) positioned, following the flow of the hot source fluid (10), downstream of the second vaporizer (7) and upstream of the third vaporizer (11) of the low temperature ORC (120), said fourth vaporizer (8) operating at a pressure lower than the pressure of the second vaporizer (7) but higher than the pressure corresponding to the evaporation temperature of the third vaporizer (11) of the cycle at low temperature (120).

7. The cascade organic Rankine cycle system (100) according to claim 6, wherein there is a double extraction of working fluid, respectively downstream of the fourth preheater (9) and downstream of the first preheater (2) towards respectively the fourth vaporizer (8) and the second vaporizer (7).

8. A method for operating a cascade ORC system, comprising a hot source fluid (10), at least a first high temperature ORC (110) and a low temperature ORC (120), said method comprising the steps of:

feeding the hot source fluid (10) in series to a first vaporizer (1) and to a first preheater (2) of the high temperature ORC (110) and then to a third vaporizer (11) of the second low temperature ORC (120) to produce a lower temperature hot source fluid (10);

supplying at least a second preheater (4) of the high temperature ORC (110) and a third preheater (14) of the low temperature ORC (120) respectively for each first vaporizer (1) and third vaporizer (11);

applying said lower temperature hot source fluid (10) to the second preheater (4) and third preheater (14) of the low temperature ORC (120), in parallel, wherein a second vaporizer (7) is fed by a partial flow of the hot source fluid (10) at the outlet of the first vaporizer (1) and in parallel with a further partial flow of the hot source fluid (10) which supplies the first preheater (2) of the high temperature ORC (110) and said second vaporizer (7) being used to produce organic fluid vapor at the intermediate pressure to be used in the at least one turbine (5) of the high temperature ORC (110).

* * * * *